United States Patent [19]

Kruse et al.

[11] Patent Number: 4,897,212

[45] Date of Patent: Jan. 30, 1990

[54] DETERGENT TABLETS FOR DISHWASHING MACHINES

[75] Inventors: Hans Kruse, Korschenbroioch; Jochen Jacobs, Wuppertal, both of Fed. Rep. of Germany

[73] Assignee: Henkel Kommanditgesellschaft auf Aktien, Duesseldorf, Fed. Rep. of Germany

[21] Appl. No.: 273,675

[22] Filed: Nov. 21, 1988

Related U.S. Application Data

[63] Continuation of Ser. No. 107,829, Oct. 13, 1987, abandoned.

[30] Foreign Application Priority Data

Oct. 13, 1986 [DE] Fed. Rep. of Germany ..... 3634813

[51] Int. Cl.[4] ..... C11D 17/00

[52] U.S. Cl. ..... 252/99; 252/135; 252/156; 252/174; 252/186.35; 252/DIG. 16

[58] Field of Search ..... 252/99, 135, 156, 174, 252/186.35, DIG. 16

[56] References Cited

U.S. PATENT DOCUMENTS 4,839,078 6/1989 Kruse ..... 252/99

*Primary Examiner*—Prince E. Willis
*Assistant Examiner*—Kathleen Markowski
*Attorney, Agent, or Firm*—Ernest G. Szoke; Wayne C. Jaeschke; Real J. Grandmaison

[57] ABSTRACT

A detergent tablet for a dishwashing machine wherein at least about 10% by weight of the tablet is dissolved in the pre-rinse cycle of said machine. The tablet comprises a mixture of hydrated sodium metasilicate, anhydrous sodium metasilicate, anhydrous penta-alkali metal tripolyphosphate wherein the ratio by weight of the anhydrous tripolyphosphate to the anhydrous sodium metasilicate is from about 1:2 to 2:1, an active chlorine compound, and a tabletting aid comprising a mixture of from about 1 to about 5% by weight of sodium acetate and from about 2 to about 6% by weight of spray-dried sodium zeolite NaA, based on the weight of the tablet.

14 Claims, No Drawings

DETERGENT TABLETS FOR DISHWASHING MACHINES

This application is a continuation of application Ser. No. 107,829, filed Oct. 13, 1987, now abandoned.

BACKGROUND OF THE INVENTION

1. Field of the Invention:

This invention relates to detergent tablets for dishwashing machines which partially dissolve in the pre-rinse cycle and the remainder dissolves in the main-wash cycle, while possessing satisfactory mechanical strength during handling.

Dishwashing in dishwashing machines generally comprises a pre-rinse cycle, a main-wash cycle, one or more intermediate rinse cycles, a clear-rinse cycle and a drying cycle. This applies both to domestic and institutional dishwashing.

Hitherto, it has been standard practice in domestic dishwashing machines, hereinafter referred to as DDWM, to store the detergent in a dispensing compartment which is generally situated in the door of the machine and which opens automatically at the beginning of the main-wash cycle. The initial pre-rinse cycle is completed solely with cold tapwater flowing into the machine.

In institutional dishwashing machines, hereinafter referred to as IDWM, the pre-removal zone corresponds in principle to the pre-rinse cycle of a DDWM. In institutional machine dishwashing in large kitchens, the detergent fed into the main-wash zone is actually used by overflow in the so-called pre-removal zone for the supportive removal of adhering food remains. Although there are also IDWM in which the pre-removal zone is supplied solely with fresh water, a pre-removal zone supplied with detergent solution is more effective than a pre-removal zone supplied solely with fresh water.

An object of the present invention is to apply the action principle of the dishwashing pre-removal zone of IDWM to DDWM. The addition of a detergent to the actual pre-rinse cycle was regarded as one possibility.

In tests carried out with standard DDWM detergents, the effect of this was that, in addition to the usual dispensing of the detergent from the dispensing compartment in the door of the DDWM, more of the detergent had to be introduced into the machine itself. However, it is a well-known problem that flow-deficient regions exist both at the bottom of the machine and in the liquor sump of the machine. As a result, the detergent product can never be adequately dissolved and, on completion of the pre-rinse cycle, has to be pumped off virtually unused.

Scattering detergent into the cutlery basket via the cutlery placed therein is not advisable because irreversible damage can be caused to silver and fine steel.

It has now surprisingly been found that the disadvantages mentioned above do not arise where detergent tablets according to this invention are used. The addition of one or more tablets may be effected for example in an empty part of the cutlery basket or even elsewhere in the machine.

2. Discussion of Related Art:

The use of tablet-form detergents is well documented in the patent literature. Thus, German patent application 16 17 088 describes tablets for dishwashing machines which may be obtained by tabletting a powder-form mixture of sodium silicate having a ratio of $Na_2O$ to $SiO_2$ of from 1:3.25 to 2:1 and a water content of from 0 to 20%, complex alkali metal phosphates, active chlorine compounds, low-foaming nonionic surfactants compatible with the active chlorine compounds, fillers such as alkali metal carbonates, chlorides or sulfates, white paraffin oil and tablet binders, and which are said to be storable and transportable.

German patent application 28 57 001 also describes tablets which essentially contain the same constituents but which are said to possess particularly high alkalinity which may be achieved inter alia by the addition of alkali metal hydroxide. However, high alkalinity is unsuitable for the domestic use of the detergents because, unless the detergents are properly handled, they can lead to skin irritation and, in addition, can damage decorative finishes of the dishware.

According to German patent application 33 15 950, it is particularly advantageous, so far as the required mechanical strength of detergent tablets and their high dissolving rate are concerned, not merely to tablet the mixtures of the constituents, but instead initially to prepare a co-granulate from the alkalinereacting constituents and then to tablet the co-granulate thus prepared under high pressure after the addition of further substances and tabletting aids.

In a commercial DDWM, all the tablets were introduced into the dispensing compartment which provided for the addition of powder-form or granular detergents and which is only designed to open automatically on completion of the pre-rinse cycle using cold tapwater. After about 5 to 7 minutes, by which time they have been completely flushed out from the dispenser into the dishwashing liquor by the water, the tablets develop their full activity with increasing water temperature during the 20 to 30 minute long main-wash cycle. When the tablets were introduced, for example through the cutlery basket, they entered the pre-rinse cycle of the machine, but caused increased damage to decorative finishes of the dishware on account of excessive alkalinity and/or dissolved too quickly and/or disintegrated too quickly and sank without dissolving into the liquor sump of the machine. Accordingly, the quantities of detergent available for the mainwash cycle were no longer adequate.

Accordingly, an object of the present invention is to provide a tablet having a broad solubility profile of which at least 10% by weight is dissolved in only the pre-rinse cycle of a DDWM by the cold tapwater flowing in, producing a pH value of at least 10.0 in the wash liquor, and of which at least 65% by weight and preferably at least 70% by weight is available for the main-wash cycle by virtue of its high solubility in warm water.

In the context of the invention, the solubility profile is understood to be the ratio of parts by weight of the tablet dissolved under the conditions of the pre-rinse cycle of a standard DDWM to the tablet as a whole.

Earlier filed German patent application P 35 41 145.7 describes detergent tablets having a uniform composition and a broad solubility profile for dishwashing machines, containing conventional alkaline-reacting components, more especially from the group consisting of alkali metal metasilicates and pentaalkali metal tripolyphosphates, active chlorine compounds and tabletting aids, wherein the alkali metal metasilicates consist of a mixture of sodium metasilicate nonahydrate and anhydrous sodium metasilicate while the penta-alkali metal tripolyphosphate consists of anhydrous pentasodium tripolyphosphate, the ratio by weight of anhydrous sodium metasilicate to the nonahydrate being from 1:0.3 to 1:1.5.

Earlier filed German patent application P 35 41 147.3 relates to multilayer, more especially two-layer, detergent tablets for dishwashing machines containing conventional alkaline-reacting components, more especially from the group consisting of alkali metal metasilicates and penta-alkali metal tripolyphosphates, low-foaming nonionic surfactants, active chlorine compounds and tabletting aids, characterized in that, in a first cold-water-soluble layer, they contain alkali metal metasilicate nonahydrate and penta-alkali metal tripolyphosphate containing from 7 to 22.4% by weight, and preferably from 15 to 18% by weight, water of crystallization in a ratio of from 0:1 to 1:0 and preferably in a ratio of from 0.35:1 to 1:1, based on the anhydrous substances, and low-foaming nonionic surfactants; and, in a second layer dissolving rapidly at increasing temperatures, alkali metal metasilicate and penta-alkali metal tripolyphosphate in a ratio by weight of from 2:1 to 1:2 and preferably from 1:1 to 1.7 : 1, based on anhydrous substances and active chlorine donors.

Finally, earlier filed German patent application P 35 41 146.5 relates to detergent compactates, more especially for dishwashing machines, based on conventional alkaline components, more especially from the group consisting of alkali metal metasilicates and penta-alkali metal tripolyphosphates, and standard additives of the active chlorine compound, surfactant and/or electrolyte type, characterized in that they consist of coldwater-soluble fused masses or tablets combined with substantially cold-water-insoluble tablets or fused masses which are soluble at the increasing water temperatures of the main-wash cycle of domestic dishwashing machines, the fused masses being combined with tablets and tablets with fused masses of different solubility and the cold-water-soluble tablet layers also containing sodium metasilicate nonahydrate.

The problem as stated above was also solved in all three cases mentioned above. The present invention provides a further solution.

DESCRIPTION OF THE INVENTION

Other than in the operating examples, or where otherwise indicated, all numbers expressing quantities of ingredients or reaction conditions used herein are to be understood as modified in all instances by the term "about".

According to the present invention, the problem as stated above is solved by detergent tablets having a broad solubility profile for dishwashing machines and comprising conventional alkaline-reacting components, more especially selected from the group consisting of alkali metal metasilicate and penta-alkali metal tripolyphosphates, active chlorine compounds and tabletting aids, characterized in that the alkali metal metasilicate comprises a mixture of sodium metasilicate hydrates, preferably the pentahydrate, and anhydrous sodium metasilicate while the pentaalkali metal tripolyphosphate comprises anhydrous pentasodium tripolyphosphate, the ratio by weight of anhydrous pentasodium tripolyphosphate to anhydrous sodium metasilicate being from 1:2 to 2:1 and preferably from 1:1 to 1:1.7, and in that a mixture of from 1 to 5% by weight sodium acetate and from 2 to 6% by weight of spray-dried sodium zeolite NaA is used as the tabletting aid. The ratio by weight of anhydrous sodium metasilicate to the pentahydrate is from 0:1 to 1:0 and preferably from 0:1 to 4:1.

Whereas a mixture of sodium acetate and calcium hydrogen phosphate dihydrate has hitherto always been considered to be an optimal tabletting aid, it was very surprising to find that the replacement of the calcium salt by spray-dried zeolite NaA, a compound which, even as a phosphate substitute, has a washing-active and deodorizing effect, enables sodium metasilicate nonahydrate to be partly or preferably completely replaced by sodium metasilicate pentahydrate which shows greater washing activity by virtue in particular of its very low water of hydration content. Accordingly, any mixture of anhydrous sodium metasilicate and sodium metasilicate pentahydrate may now be used.

However, to obtain complete dissolution of the tablet even in the so-called gentle-wash program of a dishwashing machine of low water consumption, for example of the Bosch S 910 type, at least 20 parts by weight of the total metasilicate component should consist of the pentahydrate.

In addition, active chlorine donors are typical constituents of detergents for DDWM.

The quality of the sodium metasilicate hydrates is largely unproblematical so far as the tabletting properties of the rawmaterial mixtures are concerned.

Where fine particle size pentasodium tripolyphosphate having an average particle diameter of smaller than 0.1 mm is used, the tabletting properties deteriorate. Accordingly, it is preferred to use a tripolyphosphate having an average particle diameter of from 0.2 to 0.3 mm.

The use of hydrothermally produced metasilicate having a residual water content of about 2% by weight results in raw material mixtures having favorable tabletting properties. However, in contrast to the tablets obtained with substantially anhydrous metasilicate, the tablets prepared from these mixtures were not stable in storage. The surface of the tablets is rough; relatively large tablets were even seen to develop cracks. Accordingly, it is best not to use this metasilicate with its residual moisture content.

Alkali metal metasilicate in anhydrous form and also as the hydrates, and also the preferably anhydrous penta-alkali metal tripolyphosphate are preferably used in the form of their sodium salts. They are present in the mixture to be tabletted in a total quantity of from 85 to 96% by weight, and preferably in a total quantity of from 90 to 95% by weight, based on the weight of the tablet.

Trichloroisocyanuric acid is preferably used as the active chlorine donor, although other known solid compounds, such as for example sodium dichloroisocyanurate, its dihydrate and potassium dichlorisocyanurate, may also be used in conventional commercial form without adversely affecting the tabletting properties. They are used in quantities of from 0.5 to 5.0% by weight, and preferably in quantities of from 1.0 to 2.5% by weight, based on the active chlorine content and the tabletting mixture as a whole.

The spray-dried zeolite NaA used as a tabletting aid constituent is extremely finely divided and almost "powders over" the washing-active substances during rapid and careful mixing and protects against separation. By virtue of its calcium-complexing properties, it also acts as a phosphate substitute. Although the phosphate component may be reduced by the quantity of zeolite NaA, its overall quantity as a tabletting aid is too small to be regarded as a phosphate substitute in the context of the invention, especially since larger quantities lead to brittle, unstable tablets with serious caking occurring in the tabletting press during the tabletting process. This caking is also partly attributable to the fact that, with relatively high zeolite NaA contents, serious separation occurs before tabletting.

The function of the anhydrous sodium acetate in the tabletting aid mixture is to reduce adhesion to tabletting equipment. The quantity in which these tabletting aids, which have no adverse effect on and may be beneficial to detergency, is used may be varied as required within the ranges indicated to enable modified formulations to be optimally tabletted. In addition, the sodium acetate content influences the solubility of the tablet. Larger quantities of sodium acetate lead in particular to improved cold-water solubility in the pre-rinse cycle. Although other standard tabletting aids, such as lubricants (stearates, talcum, glycerides, etc.) to improve the tabletting properties, and other auxiliaries may also be used in principle, they are undesireable in terms of practical application and, in addition, add to the cost of the formulation and merely represent inert fillers. There is no need to use these otherwise standard auxiliaries in the production of tablets in accordance with the invention.

Standard chlorine-stable dyes and perfumes may also be added to the tabletting mixtures. This may be done by spraying dyed, low-foaming, chlorine-stable nonionic surfactants onto the sodium metasilicate pentahydrate. For aesthetic reasons, the tablets may also be produced in colored layers having otherwise the same composition.

Tabletting of the mixture, prepared in a Lodige mixer or in a Forberg mixer, of the anhydrous metasilicate, the corresponding hydrates, the tripolyphosphate, active chlorine donor and tabletting aids may be carried out with cavity lubrication using standard lubricants. Depending on the construction of the machine, the lubricant is applied directly through bores in the cavities, by spraying the bottom force or through lubricantimpregnated felt rings on the bottom forces. However, the raw material mixtures according to the invention with their particularly favorable tabletting properties may not even require lubrication.

In order to avoid problems caused by sticking to the forces, it is advisable to coat the forces with a plastic. Plexiglas or Vulkolan coatings have proved to be particularly favorable in this regard. However, favorable results have also been obtained with other standard materials.

The tabletting conditions should be optimized to obtain the desired solubility profile coupled with adequate tablet hardness. The bending strength of the tablets may serve as a measure of their hardness (method: cf. Ritschel, "Die Tablette", Ed. Cantor, 1966, page 313). Tablets having a bending strength of greater than 12 kg and preferably greater than 15 kg are sufficiently stable under simulated transport conditions.

Corresponding tablet hardnesses may be obtained at tabletting pressures of from 500 to 5000 kp/cm$^2$ and preferably from 1000 to 1500 kp/cm$^2$. Higher tabletting pressures reduce the dissolving rate. With different compositions, solubility differences may be provided within limits through the choice of the tabletting pressure.

The specific gravity of the tablets may vary from 1.2 to 2 g/cm$^3$ and preferably from 1.5 to 1.7 g/cm$^3$. The compression applied during tabletting produces changes in the specific volume which may be from 0.8 to 1.8 cm$^3$/ g, and preferably from 1.0 to 1.4 cm$^3$/g to 0.5 to 0.8 cm$^3$/g and preferably to 0.6 to 0.7 cm$^3$/g.

The shape of the tablet can also affect its dissolving rate through the outer surface exposed to the water. For reasons of stability, tablets having a diameter-to-height ratio of from 0.6 to 1.5:1 are preferred.

The quantity of the mixture to be tabletted for the individual tablets may be varied as required within technically appropriate limits. 1, 2 or more tablets are used per machine load to provide the dishwashing process as a whole with the necessary active-substance content of detergent. Tablets weighing from 20 to 30 g are preferred, in which case two tablets have to be used. Larger tablets are generally more prone to break and, in addition, can only be formed at relatively low speeds, thus reducing output. With smaller tablets, the advantage over granulated or powder-form detergents in terms of handling would be reduced.

The described compositions may be tabletted in known manner using standard commercial eccentric presses or rotary presses.

Since there are not yet any suitable dispensers for this method of using dishwashing detergents in standard commercial dishwashing machines, the tablets may be introduced after opening the machine and before the start of the pre-rinse cycle into a zone which exposes the tablets to the dissolving power of the stream of tapwater, preferably into the cutlery basket of a domestic dishwashing machine, and the automatically controlled dishwashing process subsequently started.

Accordingly, the present invention also relates to the use of the detergent tablets for dishwashing in automatic domestic dishwashing machines, characterized in that the tablets are introduced after opening the machine into a zone which exposes the tablets to the dissolving power of the stream of cold tapwater, for example by placing in the cutlery basket, before the start of the pre-rinse cycle and the automatically controlled dishwashing process is subsequently started.

Even with difficult soil, such as for example burnt-on milk or baked-on oatmeal, dishes washed in this way are cleaner than conventionally washed dishes.

EXAMPLE I

The following composition;

60.0 % by weight sodium metasilicate pentahydrate,
30.0 % by weight sodium tripolyphosphate, anhydrous,
1.0 % by weight trichloroisocyanuric acid,
3.0 % by weight sodium acetate, anhydrous, and
6.0 % by weight zeolite NaA, spray-dried, was mixed in a Forberg mixer.

The mixture was tabletted in a Fette "Exacta 31" eccentric press in which the 30 mm tabletting tools had been coated with Vulkolan. Compression to a density of 1.57 g/cm$^3$ produced tablets weighing 25 g which showed high stability in storage and of which 16% by weight dissolved in the pre-rinse cycle and the remainder dissolved in the main-wash cycle (40° C program of a Bosch S 910).

When the tablet diameter was increased to 35 mm and the tablet weight to 40 g, the tablets were compressed to a density of 1.48 g/cm$^3$. 25% by weight of the tablets dissolved in the pre-rinse cycle of the DDWM, the remainder dissolving in the 40° C main-wash cycle. However, the tablets showed a marked tendency to break at the edges. A slight increase in density to 1.5 g/cm$^3$ resulted in caking in the tabletting press.

EXAMPLE II

The following composition was mixed in 20 kg batches in a Forberg mixer:

53.2 % by weight sodium metasilicate, anhydrous,
36.7 % by weight sodium tripolyphosphate, anhydrous,
1.2 % by weight trichloroisocyanuric acid,
3.0 % by weight sodium acetate, anhydrous, and
5.0 % by weight zeolite NaA, spray-dried.

The mixture was tabletted in a Fette "Exacta 31" eccentric press in which the 30 mm tabletting tools had been coated with Vulkolan. Compression to a density of 1.69 g/cm$^3$ produced tablets weighing 21 g which showed high stability in storage and of which 18% by weight dissolved in the pre-rinse cycle and 95% of the remainder dissolved in the main-wash cycle (40° C program of a Bosch S 910). The tablets thus produced dissolved almost completely in the domestic dishwashing machine.

EXAMPLE III

The following composition was mixed in 20 kg batches in a Forberg mixer:

44.5 % by weight sodium metasilicate, anhydrous,
11.3 % by weight sodium metasilicate pentahydrate,
35.2 % by weight sodium tripolyphosphate, anhydrous,
2.0 % by weight sodium acetate, anhydrous, and
5.0 % by weight zeolite NaA, spray-dried.

The mixture was tabletted in a Fette "Exacta 31" eccentric press in which the 30 mm tabletting tools had been coated with Vulkolan. Compression to a density of 1.61 g/cm$^3$ produced tablets weighing 22.1 g which showed high stability in storage and of which 18% by weight dissolved in the pre-rinse cycle and 100% of the remainder dissolved in the main-wash cycle (40° C program of a Bosch S 910). The tablets thus produced dissolved completely in the domestic dishwashing machine, and had the required solubility profile.

We claim:

1. A detergent tablet for a dishwashing machine wherein at least about 10% by weight of said tablet is dissolved in the prerinse cycle of said machine, said tablet consisting of from about 85 to about 96% by weight of a mixture of sodium metasilicate pentahydrate, anhydrous sodium metasilicate, and anhydrous pentaalkali metal tripolyphosphate wherein the ratio by weight of said anhydrous tripolyphosphate to said anhydrous sodium metasilicate is from about 1:2 to 2:1 and the ratio by weight of said anhydrous sodium metasilicate to said sodium metasilicate pentahydrate is from about 0:1 to 4:1, from about 0.5 to about 5.0% by weight of an active chlorine compound, and a tabletting aid consisting of a mixture of from about 1 to about 5% by weight of sodium acetate and from about 2 to about 6% by weight of spray-dried sodium zeolite NaA, based on the weight of said tablet.

2. A detergent tablet as in claim 1 wherein said tripolyphosphate comprises pentasodium tripolyphosphate, and the weight ratio of said pentasodium tripolyphosphate to said anhydrous sodium metasilicate is from about 1:1 to about 1:1.7.

3. A detergent tablet as in claim 1 wherein said anhydrous tripolyphosphate has an average particle size greater than about 0.1 mm.

4. A detergent tablet as in claim 1 wherein said active chlorine compound is selected from trichloroisocyanuric acid, dichloroisocyanuric acid, and the sodium or potassium salt thereof.

5. A detergent tablet as in claim 1 wherein said tablet has a specific gravity of from about 1.2 to about 2 g/cm$^3$.

6. A detergent tablet as in claim 1 wherein said tablet has a diameter-to-height ratio of from about 0.6 to 1.5:1.

7. A detergent tablet as in claim 1 wherein said tablet weighs from about 20 to about 30 grams.

8. The process of washing dishware in an automatic domestic dishwashing machine comprising introducing a detergent tablet into a zone of said machine which exposes said tablet to the dissolving power of a stream of cold tapwater before the start of the pre-rinse cycle, and starting the automatically controlled dishwashing process wherein at least about 10% by weight of said tablet is dissolved in the pre-rinse cycle of said machine, said tablet consisting of from about 85 to about 95% by weight of a mixture of sodium metasilicate pentahydrate, anhydrous sodium metasilicate, and anhydrous penta-alkali metal tripolyphosphate wherein the ratio by weight of said anhydrous tripolyphosphate to said anhydrous sodium metasilicate is from about 1:2 to 2:1 and the ratio by weight of said anhydrous sodium metasilicate to said hydrated sodium metasilicate pentahydrate is from about 0:1 to 4:1, from about 0.5 to about 5.0% by weight of an active chlorine compound, and a tabletting aid consisting of a mixture of from about 1 to about 5% by weight of sodium acetate and from 2 to about 6% by weight of spray-dried sodium zeolite NaA, based on the weight of said tablet.

9. The process as in claim 8 wherein said tripolyphosphate comprises pentasodium tripolyphosphate, and the weight ratio of said pentasodium tripolyphosphate to said anhydrous sodium metasilicate is from about 1:1 to about 1:1.7.

10. The process as in claim 8 wherein said anhydrous tripolyphosphate has an average particle size greater than about 0.1 mm.

11. The process as in claim 8 wherein said active chlorine compound is selected from trichloroisocyanuric acid, dichloroisocyanuric acid, and the sodium or potassium salt thereof.

12. The process as in claim 8 wherein said tablet has a specific gravity of from about 1.2 to about 2 g/cm$^3$.

13. The process as in claim 8 wherein said tablet has a diameter-to-height ratio of from about 0.6 to 1.5:1.

14. The process as in claim 8 wherein said tablet weighs from about 20 to about 30 grams.

* * * * *

UNITED STATES PATENT AND TRADEMARK OFFICE

CERTIFICATE OF CORRECTION

PATENT NO. : 4,897,212

DATED : January 30, 1990

INVENTOR(S) : Hans Kruse et al.

It is certified that error appears in the above-identified patent and that said Letters Patent is hereby corrected as shown below:

In Claim 8, Column 8, line 30, "95%" should read --96%--.

In Claim 8, Column 8, line 37, "hydrated" should be deleted.

Signed and Sealed this

Twenty-eighth Day of May, 1991

*Attest:*

HARRY F. MANBECK, JR.

*Attesting Officer*

*Commissioner of Patents and Trademarks*